US007281485B1

(12) United States Patent
Bach

(10) Patent No.: US 7,281,485 B1
(45) Date of Patent: Oct. 16, 2007

(54) WINDSHIELD TRIM ASSEMBLY AND METHOD

(76) Inventor: Darren A. Bach, c/o Pacific Coast Marine Windshield, Ltd., 7993 Progress Way, Delta, B.C. (CA) V3M 6H4

( * ) Notice: Subject to any disclaimer, the term of this patent is extended or adjusted under 35 U.S.C. 154(b) by 0 days.

(21) Appl. No.: 11/156,368

(22) Filed: Jun. 16, 2005

(51) Int. Cl.
*B63B 17/00* (2006.01)

(52) U.S. Cl. ..... 114/361

(58) Field of Classification Search ..... 114/361; 296/96.21

See application file for complete search history.

(56) References Cited

U.S. PATENT DOCUMENTS

| | | | | |
|---|---|---|---|---|
| 2,556,775 | A * | 6/1951 | Oswald | 52/208 |
| 2,937,652 | A | 5/1960 | Zimmer, Jr. et al. | |
| 3,016,548 | A * | 1/1962 | Taylor | 114/361 |
| 3,021,535 | A | 2/1962 | Dorst | |
| 3,172,419 | A | 3/1965 | Lewis | |
| 3,654,648 | A | 4/1972 | Wilhoit | |
| 3,810,267 | A | 5/1974 | Fussell, Jr. et al. | |
| 3,978,535 | A | 9/1976 | Swan et al. | |
| 4,151,620 | A | 5/1979 | Heuzonter | |
| 4,349,994 | A | 9/1982 | Maekawa | |
| 4,750,449 | A | 6/1988 | Muhlberger | |
| 4,815,410 | A | 3/1989 | Muhlberger | |
| 4,993,351 | A | 2/1991 | Zirkelbach et al. | |
| D324,368 | S | 3/1992 | Zirkelbach et al. | |
| 5,189,980 | A | 3/1993 | Zirkelbach et al. | |
| 5,269,250 | A | 12/1993 | Daniels | |
| 5,367,977 | A | 11/1994 | Ellis et al. | |
| 5,601,050 | A * | 2/1997 | Erskine et al. | 114/361 |
| 6,647,915 | B1 * | 11/2003 | Bach | 114/361 |
| 2002/0020337 | A1 | 2/2002 | Eck et al. | |

* cited by examiner

*Primary Examiner*—Stephen Avila

(57) ABSTRACT

A windshield trim assembly for stretch-forming to fit on an edge of a curved windshield is disclosed. The trim assembly has an aesthetically pleasing elongated panel and an elongated base member, which base member includes a windshield-receiving channel, a side-facing longitudinally-extending panel-receiving channel having a bottom and two sides, and a cantilevered lip extending from one side and partially over the bottom of the panel-receiving channel. The cantilever lip plastically deforms to secure the elongated panel within the side facing panel-receiving channel of the base member upon stretch-forming the combination. The elongated panel is preferably roll formed stainless steel, while the base member is preferably an aluminum extrusion. A method of stretch-forming such a curved trim assembly for a boat windshield also is disclosed.

16 Claims, 4 Drawing Sheets

WINDSHIELD TRIM ASSEMBLY AND METHOD

TECHNICAL FIELD

The present invention relates, in general, to edge trim assemblies of the type mounted on boat windshields, and more particularly, to boat windshield trim extrusions or headers and methods for their formation.

BACKGROUND ART

Trimming or finishing the edges of boat windshields has become more complex over the years as the windshield shapes have progressed from simple rectangular panes to complexly curved and obliquely oriented windshields. The most common approach currently in use is to employ a metal extrusion which is stretch-formed on a die to the curved shape of the edge of the windshield glass to be trimmed. Usually the edge trimming extrusion is formed from aluminum and has legs or arms that define a windshield receiving longitudinally extending channel. A gasket, such as a vinyl or thermoplastic gasket, is mounted between the windshield channel in the extrusion and the glass so as to seal and cushion the windshield edge assembly.

Typical boat windshield top edge or header extrusions are designed primarily for use along the top edge of the boat windshield, but numerous patents also exist which relate to boat windshield mounting extrusions that extend along the bottom edge of the windshield and mount the windshield to the deck of the boat. Typical header extrusions and typical mounting extrusions are made of record in the inventor's prior U.S. Pat. No. 6,647,915 ("the '915 patent") entitled WINDSHIELD TRIM ASSEMBLY AND METHOD, the entire contents of which is incorporated herein by reference.

Boat windshield top edge assemblies or extrusions, including those described in the '915 patent, perform several functions. They provide an aesthetic finish for the top edge of the windshield. They act as wear surfaces which prevent damage to the windshield, and they can be used for securement of canopies or Bimini tops to the windshield. Bottom edge assemblies can also provide an aesthetic finish while coupling the windshield to a hull or deck.

The prior art windshield edge assemblies have been found to have certain limitations. Brushed and anodized aluminum can have a very nice appearance, but it would also be highly desirable to use other appearance enhancing materials, for example, stainless steel. To some degree plastics have been employed, but they lack the durability which would otherwise be desirable. Additionally, some of the windshield edge assemblies are highly reflective and can be a distraction to the boat driver under certain sun conditions. Finally, while aluminum has greater durability than plastics, unless very expensive and heat treated or electro-polished aluminums are employed, they still do not have the durability and wear strength which would otherwise be desirable.

Accordingly, it is an object of the present invention to provide improved windshield trim assemblies, and methods of forming the same that are well suited for use with curved boat windshields on top, bottom and side edges.

Another object of the present invention is to provide an improved composite windshield trim assembly in which different materials can be employed and interlocked together during stretch-forming the windshield edge assembly into a curved configuration suitable for mounting on a boat windshield.

Another object of the present invention is to provide an improved windshield trim assembly having increased durability and aesthetic flexibility.

A further object is to provide an improved windshield trim assembly and method which is more cost effective in its ability to incorporate expensive appearance enhancing materials, and have greater ease of manufacture.

Still a further object of the present invention is to provide an improved windshield trim assembly which is less reflective in the direction of the boat driver, and is adaptable to a wide range of curved windshield edge configurations.

The windshield trim assemblies and method of the present invention have other objects and features of advantage which will become apparent from and are set forth in more detail in the accompanying drawings and the following detailed description.

SUMMARY OF THE INVENTION

The windshield trim assembly of the present invention is designed for stretch-forming to fit on an edge of a curved windshield and includes, briefly, an elongated base member including a windshield-receiving channel, a side-facing longitudinally-extending panel-receiving channel having a bottom and two sides, and a cantilevered lip extending from one side and partially over the bottom of the panel-receiving channel; and an elongated panel mounted in the panel-receiving channel and secured therein by the cantilevered lip.

More particularly, the windshield-receiving channel preferably includes a pair of legs joined by a cross piece, and the panel-receiving channel is formed by one leg of the pair and a portion of the base member above the cross piece. In other preferred embodiments, the base member includes another cantilevered lip extending from the other side and partially over the bottom of the panel-receiving channel, the another lip further securing the elongated panel within the panel-receiving channel. Most preferably, the bottom surface of the panel-receiving channel is outwardly convex. Preferably, the base member is a monolithic aluminum extrusion and the elongated panel is roll-formed stainless steel. Most preferably, the panel is a flat panel.

In a second aspect of the present invention, a method for forming a trim assembly for a curved windshield is provided which includes, briefly, the steps of mounting an elongated panel in a side-facing panel-receiving channel of a base member, which base member includes a cantilever lip partially extending over the panel; followed by stretch-forming the elongated panel and base member while mounted together by longitudinally and arcuately plastically deforming the base member by an amount and in a transversely curving direction producing tight interlocking interengagement between the elongated panel and the base member. During stretch-forming, the cantilever lip plastically deforms to secure the panel within the channel and, preferably, a convex-out channel bottom bears against the panel to conform the panel to the channel bottom's shape.

DETAILED DESCRIPTION OF THE INVENTION

Reference will now be made in detail to preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

The windshield trim or edge assembly of the present invention is particularly well suited for curved windshields of the type commonly found on pleasure boats, but it can be used in other applications, including non-marine applications. The edge assembly of the present invention has been designed for formation using stretch-forming techniques, which are broadly well known and extensively used in the boat windshield manufacturing industry.

Figure 1:
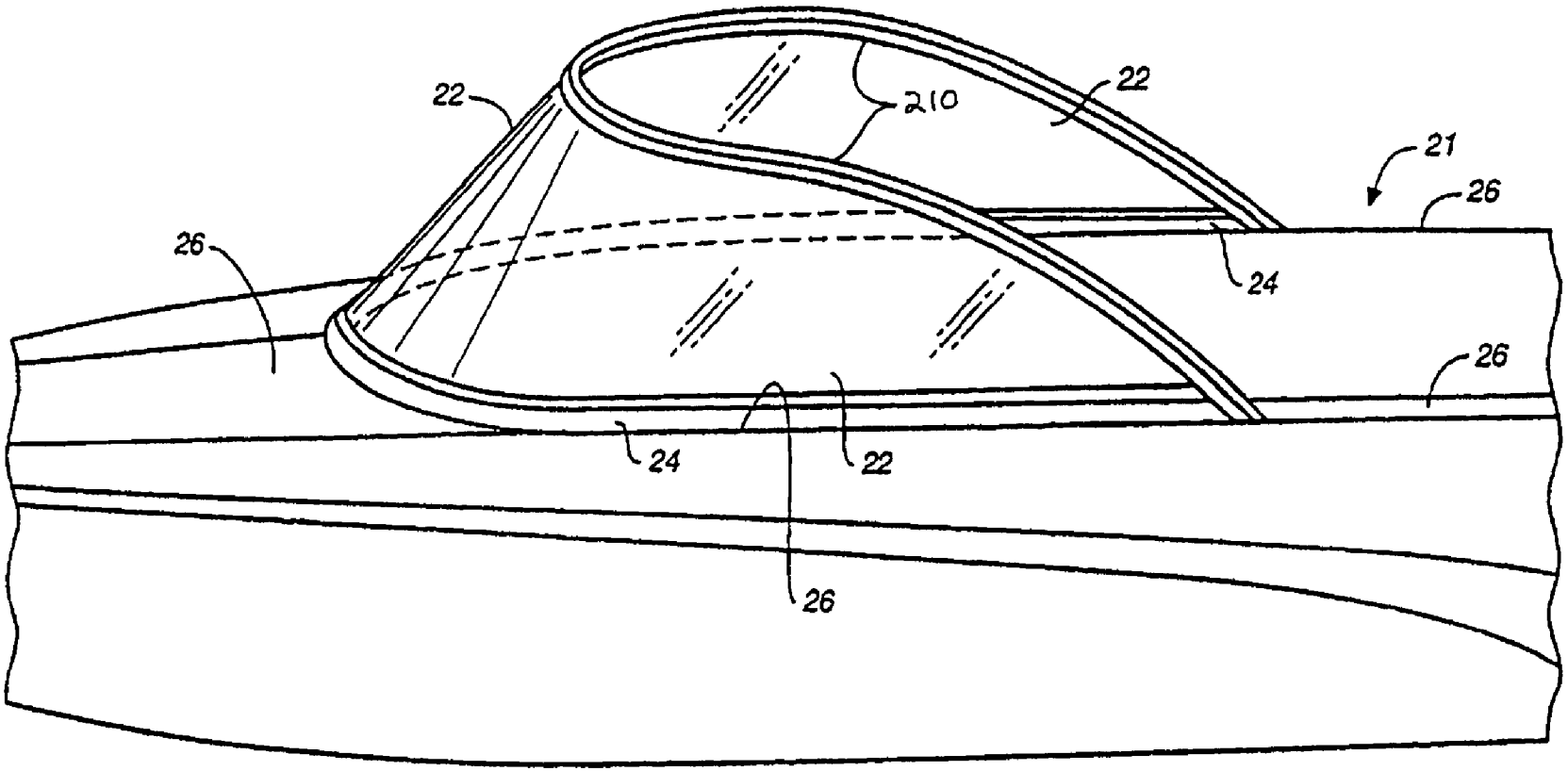
FIG. 1 is a fragmentary top perspective view of a boat having a curved windshield secured to the hull and trimmed with windshield edge assemblies constructed in accordance with the present invention.

FIG. 1 shows boat 21 having a windshield 22 which is dramatically curved and swept back along the sides of the boat. Mounted on top of the upper edge of the curved windshield is a trim or edge assembly 210 constructed in accordance with the present invention. FIG. 1 also shows a lower extrusion or boat windshield mounting extrusion 24 that, in accord with the invention, is curved and used to mount the windshield to hull 26 of the boat.

Forming top edge assembly 210 to conform to the edge of swept back and curved windshield 22 is usually accomplished by employing a stretch-forming process, which is well known in the boat windshield industry. Briefly, such stretch-forming processes include the steps of positioning a "snake" or elongated support member in open portions of the assembly to prevent collapse during stretch-forming. Such open portions include, for example, a windshield receiving channel as well as an open hook shaped portion of assemblies which secure a windshield to a boat deck or hull. The straight extrusion with snake(s) will be gripped at its ends by hydraulic grippers and stretching longitudinally commenced when a curved die is brought into contact with the extrusion. The die has a configuration which essentially matches the upper edge of the curved windshield in FIG. 1. The extrusion is pulled or stretched and arcuately formed along the length of the die to plastically deform and elongate the extrusion. Typically, an 8 foot long straight extrusion will have its length increased by about 3 inches in the stretch-forming or plastic deformation process.

The stretch-forming process, briefly described above, is well known in the art and as thus far described does not contain novel subject matter.

Figure 3:
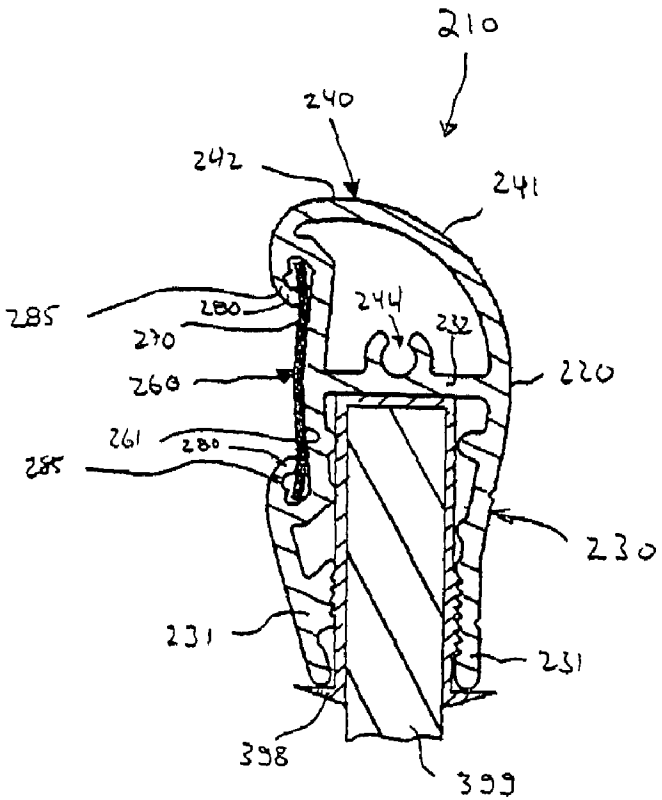
FIG. 3 is an end elevation view, in cross section, corresponding to FIG. 2 and showing the trim assembly after being stretch formed into a curved configuration and mounted on a windshield with a gasket.
Figure 2:
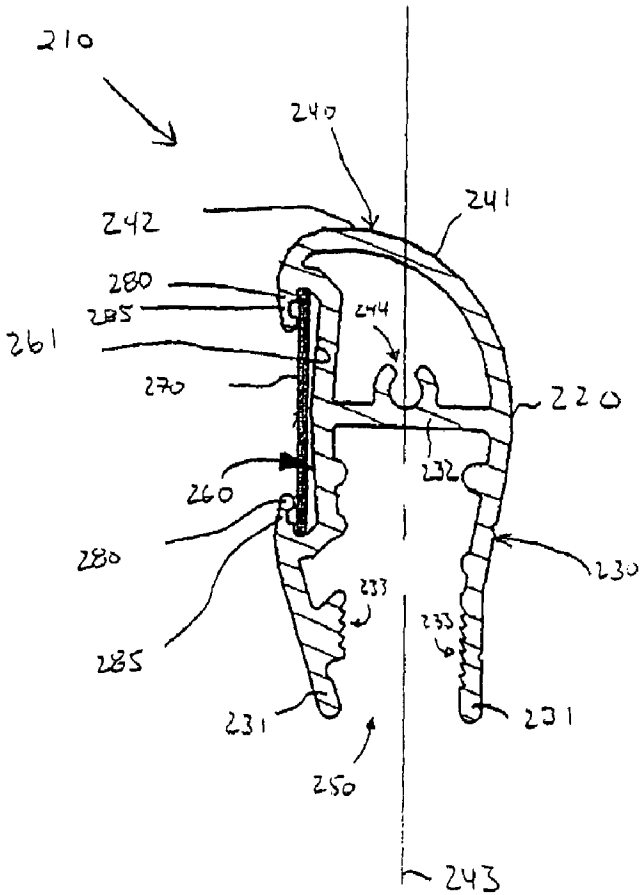
FIG. 2 is an end elevation view, in cross section, of a windshield trim assembly of the present invention prior to mounting on a windshield and prior to stretch-forming into a curved configuration.

FIG. 2 and FIG. 3 illustrate one embodiment of the windshield trim or edge assembly of the present invention in detail. Many variations from this example are within the principles of the present invention. In FIG. 2, the assembly is shown prior to stretch-forming and prior to mounting of the same on a windshield edge. In FIG. 3, the assembly has been stretch formed and subsequently mounted to a windshield. In some aspects, the present invention is similar to that described in the inventor's prior '915 patent, the entire contents of which is incorporated herein by this reference.

In FIG. 2 and FIG. 3, an edge or trim assembly, generally designated 210, includes an elongated base member 220 having a longitudinally extending lower portion, generally designated 230, and a longitudinally extending upper portion, generally designated 240. Located on the lower portion or upper portion, or both, is a side facing, longitudinally extending panel-receiving channel 260. Panel 270 is located within the panel-receiving channel.

According to a broad aspect of the invention, elongated base member 220 and elongated panel 270 are formed as separate elements and then mounted together to produce the assembly of FIG. 2 and FIG. 3. This is particularly advantageous in terms of cost effectiveness because it allows the panel to be made of an aesthetically pleasing and relatively expensive material while at the same time not requiring that all of the assembly be made of the more expensive material. Indeed only a small amount of the more expensive material is needed to have a pleasing and distinguishing appearance.

Accordingly, base member 220 is typically made of a first material such as aluminum (for example, 6063 aluminum) in a single piece monolithic extrusion. Multiple pieces and forming methods other than extrusion forming are equally in accord with the present invention. Furthermore, one will appreciate that other materials may be used including, but not limited to, other suitable metals and alloys.

In contrast, panel 270 is typically made of a second material different than the first. The second material may be metal, such as stainless steel, or brass, or aluminum with an electro-polished or anodized or chromed finish. The second material may also be non-metallic, for example, plastics and colored plastics. Many other materials are in accord with the invention and vary by aesthetic taste and desired distinctiveness. In some embodiments, the panel may also include ornamental designs. Preferably, the panel has a simple and easy-to-manufacture shape such as a flat panel or a top hat cross section. More complex panels, for example with curved cross sections, are equally in accord with the present invention.

Together, the small proportion of the more expensive material of panel 270 and a simple shape allow one to reap the benefits of an eye-catching and product-distinguishing design at a much lower cost. If cost is less of a concern, the base member 220 may, in accord with the present invention, have an electro-polished or anodized or chromed finish, or be made of comparatively more expensive material.

Besides economic advantages, the configuration of the present invention having an outwardly-facing panel arrangement with an often shiny aesthetic piece has the technical advantage of eliminating glare from the aesthetic piece, which glare may otherwise distract a boat operator.

Referring still to FIG. 2 and FIG. 3, lower portion 230 includes downwardly depending legs 231 and cross piece 232, which together define windshield-receiving channel 250. As used herein, the expression "windshield-receiving channel" shall be understood to mean a channel that is formed and dimensioned to receive the edge of a windshield with a gasket, such as a vinyl or rubber gasket, mounted between the windshield and the downwardly depending legs. Typically, the legs include inwardly facing riblets 233, which engage and grip the gasket. Preferably, inwardly facing sides of both legs include riblets, although some embodiments may have riblets on only one leg. While not mounted in the assembly of FIG. 2 during stretch-forming, FIG. 3 shows gasket 398 and windshield 399 for purposes of understanding.

Upper portion 240 of base member 220 includes a top profile 241 with an apex 242. Preferably the apex of the top profile is offset from centerline 243 towards panel-receiving channel 260. Such an offset from center to a position more closely aligned with the panel-receiving channel is advantageous for transferring forces during the stretch-forming process, as described in more detail below.

Optionally, upper portion 240 also includes a fastener-receiving channel 244. In preferred embodiments, one attaches an end of base member 220 to a surface such as a boat deck or hull 26 (See FIG. 1) by driving a self-threading screw through the surface and into the fastener-receiving channel in a direction perpendicular to the plane of FIG. 2. Walls of the fastener-receiving channel provide an engagement surface into which the self-threading screw forms threads to fasten the base member to the surface.

When finishing an end of assembly 210, embodiments of the present invention advantageously have only a small portion of panel material to saw through. In typical embodiments, base member 220 is made of aluminum and panel 270 is made of stainless steel, which is comparatively more difficult to cut.

In the embodiment illustrated by FIG. 2 and FIG. 3, a portion of one of legs 231 and a side of upper portion 241 form side-facing panel-receiving channel 260 with channel bottom 261 centered on cross piece 232. Alternate embodiments, however, may have the side-facing panel-receiving channel located such that the cross piece is away from the channel bottom's center. Preferably, the channel bottom has a convex-out shape, which is advantageous in the stretch-forming process described below because such a shape will bear against the panel to conform the panel to the channel bottom's shape. Other embodiments, however, have a flat channel bottom.

In the embodiment shown in FIG. 2, one leg 231 of the pair of legs includes a cantilevered lip 280 extending over side facing panel-receiving channel 260. In preferred embodiments, portions of the cantilevered lip have a thinned zone 285, in which the material cross section is reduced. Such a thinned zone is advantageous in the stretch-forming process, as described below. Upper portion 240 also includes a similar cantilevered lip 280 extending over the side facing panel-receiving channel. While two cantilevered lips with thinned zones are most preferred, alternate embodiments may instead have only one cantilevered lip and a fixed longitudinal slot or shoulder.

FIG. 2 shows that cantilevered lips 280 loosely retain panel 270 in side facing panel-receiving channel 260 prior to stretch-forming. This looseness accommodates variation in the dimensions of the panel and base member and allows the panel to be easily slid into the panel-receiving channel of the base member from one end.

The assembly of the panel and the base member, as shown in FIG. 2, is useful in stretch-forming a windshield edge assembly to the edge of a curved boat windshield, and as such, the assembly shown in FIG. 2, even before stretch-forming, comprises one aspect of the claimed invention.

FIG. 3 shows trim or edge assembly 210 after being stretch-formed about a generally vertical axis 243, the stretch curving to the right in FIG. 3. As used herein, therefore, the "first side" or the "front facing" side of the components comprising assembly 210 will be the convex or left side of FIG. 2 and FIG. 3. The "second side" or "rear facing" side will be the concave or right side of assembly 210. One will appreciate that the axis around which the windshield is curved may be inclined from the vertical and varying in its inclination to produce a complex twisting orientation matching the windshield edge.

In a typical stretch-forming process, a hydraulic machine grips assembly 210, and with a form or die applies forces thereon from the right side, top, and bottom directions of the figures. As described above, open portions of the assembly's cross-section are filled beforehand with removable material in order to aid in transmitting force across the open portions and to prevent collapse of the structure. When, for example, assembly 210 is pulled to the right of the figures against a die, force is transmitted from the die through cross piece 232 and to channel bottom 261, and the force bows the channel bottom outwardly toward the left as viewed in the figures, which bowing urges panel 270 to partially conform to the channel bottom's shape.

In a second effect, as the assembly is pulled along a curve to the right of the figures and internal stresses build, the structure of base member 220 will attempt to ease the tension through plastic deformation. In the region of cantilevered lips 280, the unsupported ends of the lips will tend to curl inward toward the center of curvature, which eases tension by reducing an arc length along which the region is being stretched, sometimes referred to as a "drawstring effect." Thus, there is a tendency to deform to the right of the figures. An area likely to deform or curl first is an area with reduced structural strength, such as thinned zone 285 of the cantilevered lip.

A comparison of FIG. 2 and FIG. 3 shows the result of a stretch-forming process: base member 220 and panel 270 are plastically deformed and the fit is transformed from being loose to being a tightly interlocking interengagement. Cantilevered lips 280 have deformed inwardly to secure the elongated panel within the side facing panel-receiving channel. As well, channel bottom 261 has pressed against the panel and urged the panel to conform to the channel bottom's shape.

FIG. 3 also shows an edge 399 of a curved windshield mounted in windshield receiving channel 250 between legs 231 of base member 220. Gasket 398 is compressed into riblets 233 formed in the legs. In other preferred embodiments (not shown), the gasket has outwardly extending riblets of its own which further ensure capturing of the gasket tightly between the windshield edge 399 and the legs. In the preferred method of assembly, the gasket is placed on the edge of the windshield and then the assembly is pressed into the windshield-receiving channel between the legs.

Having described the apparatus of the present invention, the method of forming a trim or edge assembly for a curved windshield can be described. The present method includes a step of mounting an elongated panel 270 on an elongated base member 220. The base member has a windshield edge-receiving channel 250 and a side facing panel-receiving channel 260. The panel is formed and dimensioned to mount loosely in the panel-receiving channel provided on the base member.

An additional step of the present invention is to stretch form panel 270 and base member 220, while mounted together, by longitudinally and arcuately plastically deforming the panel and base member by an amount, and in a transverse curving direction, producing tight interlocking interengagement between the panel and the base member. During the stretch-forming step, a cantilevered lip extending over the panel plastically deforms to secure the panel to the base member in the side facing panel-receiving channel. In preferred embodiments, a convex-out channel bottom also bears against the panel and urges the panel to conform to the channel bottom's shape.

Elongated panel 270 is initially loosely mounted to elongated base member 220 and becomes tightly interlocked with the base member during the stretch-forming step. The stretch-forming step is preferably accomplished using a die which urges the plastic deformation described above.

Prior to the mounting and stretch-forming steps, the present method also preferably includes the step of extruding elongated base member 220 to have side facing panel-receiving channel 260 with cantilevered lip 280 overextending the channel, and the step of forming and dimensioning elongated panel 270 to matingly engage with the side facing panel-receiving channel. Most preferably, base members are extruded from an aluminum material and the panel is roll formed from a stainless steel material. The present method also preferably includes the step of mounting trim or edge assembly 210 on a mounting gasket 398 carried by the edge 399 of a curved windshield.

The method and apparatus of the present invention, therefore, produce a trim or edge assembly for a curved windshield having many aesthetic, strength and cost advantages as compared to currently employed systems.

Figure 4:
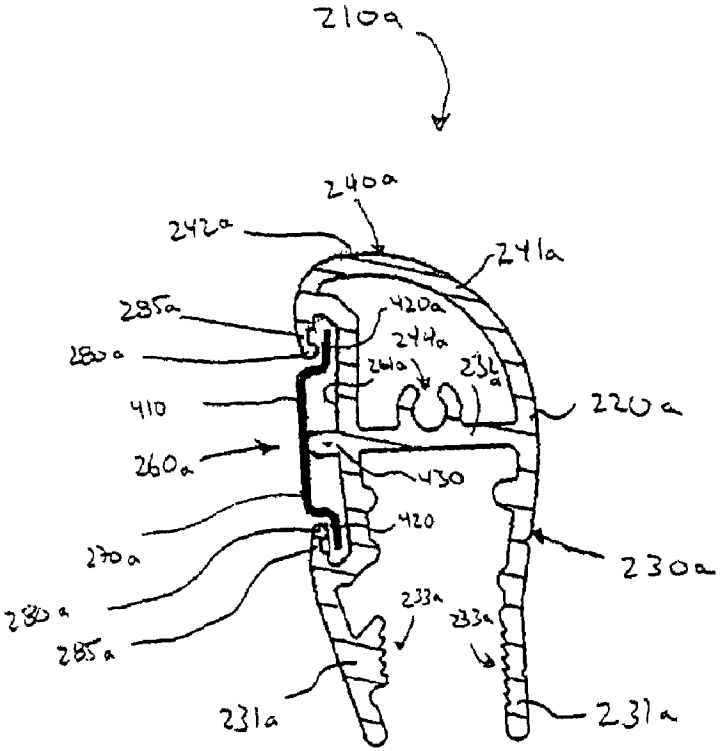
FIG. 4 is an end elevation view, in cross section, of another windshield trim assembly having a panel with a top hat cross section, prior to mounting on a windshield and prior to stretch-forming into a curved configuration.

FIG. 4 shows an alternate embodiment of elongated panel 270*a* and base member 220*a*. In FIG. 4, the panel is not a flat panel. Rather, the cross section of the panel is a top hat with top portion 410 and brims 420. Alternate embodiments may have a curved cross section. Preferably, all embodiments of the elongated panel have a brim portion over which a cantilever lip extends when the panel is mounted in longitudinally extending panel-receiving channel 260*a*. During plastic deformation, the cantilever lip will plastically deform to secure the panel within the channel by such a brim portion, as further described below.

In FIG. 4, base member 220*a* includes ridge 430 to partially fill a gap between top portion 410 of panel 270*a* and the channel bottom 261*a*. As described below, such a ridge will bear against top portion 410 during stretch-forming to conform a segment of the panel to the ridge's shape. Alternate embodiments may include ridges of differing gap-filling dimensions, or separate filler strips made of plastic or other suitable material, which can be inserted between top portion 410 and channel bottom 261.

Figure 5:
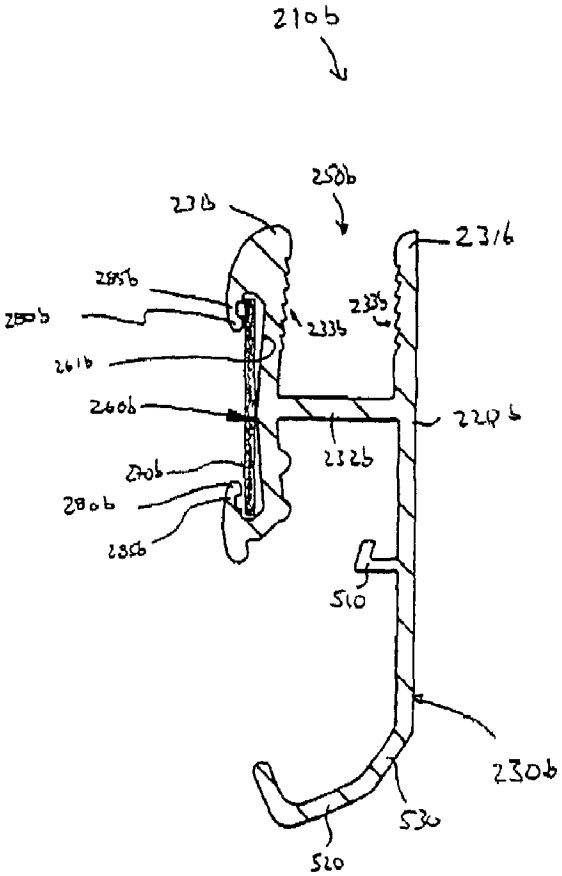
FIG. 5 is an end elevation view, in cross section, of a windshield trim assembly of the present invention suitable for securing the windshield bottom edge to a boat hull, prior to stretch-forming into a curved configuration and prior to mounting on a windshield.

FIG. 5 shows, in cross section, an exemplary embodiment suitable for providing an aesthetic trim and securing a windshield bottom edge to the boat hull or deck 26 shown in FIG. 1. As in FIG. 2, the edge assembly in FIG. 5 includes an elongated base member 220 and elongated panel 270 prior to stretch-forming and prior to mounting on a windshield. Corresponding elements are numbered similarly. In contrast to FIG. 2, however, window-receiving channel 250 is oriented to be on top in FIG. 5. When mounted on a boat, the hull or deck would be below the assembly.

In the embodiment shown in FIG. 5, lower portion 230*b* has an open hook shaped cross section. The open cross section provides access to the interior of the lower portion, which is advantageous when mounting assembly 210*b* to a boat. To mount the assembly, one typically drills a series of holes (not shown) through fastener receiving portions 520 and/or 530 along the length of the assembly as determined by the curvature and rake of the windshield. Catch 510 is optional to secure a pop-out fastener cover (not shown), such as a plastic strip.

Because lower portion 230*b* is open in this embodiment, a filler, or "snake" material is inserted into the lower portion prior to stretch-forming to prevent the hook shape from curling or collapsing under the applied forces. Properly filled, the filler or snake material will transfer the forces and the structure will plastically deform as the embodiment shown in FIG. 2 and FIG. 3, with cantilevered lips 280*b* plastically deforming inward to secure panel 270*b* in panel-receiving channel 260*b* and channel bottom 261*b* pressing against the panel to conform the panel to the channel bottom's shape.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A windshield trim assembly for stretch forming to fit on an edge of a curved windshield, comprising:

an elongated base member including a windshield-receiving channel, a side-facing longitudinally-extending panel-receiving channel having a bottom and two sides, and a lip appending from the sides wherein at least one lip is cantilevered to partially extend over the bottom of the panel-receiving channel; and an elongated panel mounted within the panel-receiving channel; wherein the cantilevered lip is accurately plastically deformable towards the bottom of the panel-receiving channel, the cantilevered lip permanently securing the elongated panel within the panel-receiving channel.

2. The windshield trim assembly of claim 1, wherein the windshield-receiving channel includes a pair of legs joined by a cross piece and the panel-receiving channel is formed by one leg of the pair and a portion of the base member above the cross piece.

3. The windshield trim assembly of claim 1, wherein the cantilevered lip has a reduced thickness thereunder mid section of the cantilevered lip, the reduced thickness further securing the elongated panel within the panel-receiving channel.

4. The windshield trim assembly of claim 1, wherein the bottom of the panel-receiving channel is outwardly convex bearing onto the underside of the panel so as to force the panel to convex, longitudinally.

5. The windshield trim assembly of claim 1, wherein the base member is monolithically formed.

6. The windshield trim assembly of claim 1, wherein the base member is an extrusion.

7. The windshield trim assembly of claim 1, wherein the base member is made from aluminum.

8. The windshield trim assembly of claim 1, wherein the panel is roll-formed into a top-hat cross-section.

9. The windshield trim assembly of claim 1, wherein the panel is made of stainless steel.

10. A windshield assembly, comprising:

the windshield trim assembly of claim 1, and a curved windshield having a windshield edge, the windshield edge mounted in the windshield-receiving channel.

11. A boat, comprising:

the windshield trim assembly of claim 1, a curved windshield having a windshield edge, the windshield edge mounted in the windshield-receiving channel; and a deck to which the windshield trim assembly and curved windshield are mounted.

12. A method for forming a trim assembly for a curved windshield, comprising:

mounting an elongated panel within a side-facing panel-receiving channel of a base member, the base member including at least one cantilevered lip partially extending over the panel; and stretch-forming the elongated panel and base member using a die on rear side face of the base member while mounted together, by longitudinally and accurately plastically deforming the base member in a transversely curving direction where at least one deformable cantilevered lip produces a tight permanent interlocking interengagement between the elongated panel and the base member.

13. The method of claim 12, wherein the bottom surface of the panel-receiving channel is outwardly convex thereby causing the panel to take a similar convex shape as the panel comes into contact with the convex channel bottom during stretch-forming.

14. The method of claim 12, wherein the elongated panel is loosely mounted to the base member during the mounting step and becomes tightly and permanently interlocked to the base member during the stretch-forming step.

15. The method of claim 12, further comprising, before the mounting step;

extruding the base member to have the side facing panel-receiving channel and cantilevered lip; and forming and dimensioning the elongated panel prior to matingly mounting in the side facing panel-receiving channel.

16. The method of claim 14, wherein the step of forming the panel is accomplished using a roll-forming process.

* * * * *